United States Patent [19]

Yamada

[11] Patent Number: 4,669,856

[45] Date of Patent: Jun. 2, 1987

[54] WARNING DEVICE FOR DEVELOPER CONTROL

[75] Inventor: Yoshikado Yamada, Kashihara, Japan

[73] Assignee: Sharp Kabushiki Kaisha, Osaka, Japan

[21] Appl. No.: 773,131

[22] Filed: Sep. 6, 1985

[30] Foreign Application Priority Data

Sep. 10, 1984 [JP] Japan ..... 59-190762
Sep. 10, 1984 [JP] Japan ..... 59-190764

[51] Int. Cl.[4] ..... G03G 15/06

[52] U.S. Cl. ..... 355/3 DD; 355/14 CU; 355/14 D

[58] Field of Search ..... 355/3 DD, 14 D, 14 SH, 355/14 R, 14 CU, 3 R

[56] References Cited

U.S. PATENT DOCUMENTS 3,529,546 9/1970 Kollar ..... 355/14 D
4,032,225 6/1977 Williams ..... 355/14 D
4,101,214 7/1978 Irie et al. ..... 355/14 D

*Primary Examiner*—R. L. Moses
*Attorney, Agent, or Firm*—Birch, Stewart, Kolasch & Birch

[57] ABSTRACT

In a copying machine including a sensor for detecting the concentration of a developer within a developing unit, and a developer supply unit for supplementing a developer into the developing unit when the concentration of the developer detected by the sensor is lower than a predetermined value, a warning device is provided which includes a counter for counting the number of copies being made and capable of being reset each time the developer is supplemented from the developer supply unit onto the developing unit. A warning unit is also provided which is indicates when the number of copies counted by the counter exceeds the maximum possible number of copies that can be made until the concentration of the developer fully contained in the developing unit decreases to a value lower than a predetermined value.

2 Claims, 6 Drawing Figures

WARNING DEVICE FOR DEVELOPER CONTROL

BACKGROUND OF THE INVENTION

The present invention generally relates to a developer supply unit in an electrophotographic copying machine and, more particularly, to a warning device for providing an indication of the occurrence of an abnormality in the control of the concentration of a developer powder such as toner.

In general, the automatic control device for the toner concentration currently utilized in electrophotographic copying machines comprises a sensor for detecting the concentration of toner within a developing unit, and a toner supply unit for supplementing toner into the developing unit when the concentration of the toner detected by the sensor comes to be of a value lower than a predetermined value.

However, according to the prior art, in the event that an abnormality occurs in the sensor and/or the concentration control device to such an extent that one or both of them fail to operate properly, the toner replenishment will not take place even if the toner concentration within the developing unit is lowered. The continued performance of cycles of a copying operation while the toner concentration has been lowered will further lower the toner concentration within the developing unit with the consequence that not only will the quality of images reproduced on copy papers be deteriorated, but also if the developer employed is of two component type consisting of toner particles and carrier particles, some of the carrier particles will undesirably flow onto the photosensitive medium and into the interior of the copying machine. In particular, where the carrier particles flow onto the photosensitive medium and into the interior of the copying machine, not only does the developer lose its function, but also the copying machine itself will be adversely affected and will not operate properly.

SUMMARY OF THE INVENTION

The present invention has been devised with a view to substantially eliminating the above described disadvantages and inconveniences inherent in the prior art automatic control for the developer concentration and has for its essential object to provide a warning device capable of providing an indication of the occurrence of abnormality in one or both of the sensor and the concentration control unit in the automatic developer concentration control device.

To this end, the warning device according to one aspect of the present invention is characterized by the provision of a counter for counting the number of copies being made and capable of being reset each time the developer is supplemented from the developer supply unit onto the developing unit, and a warning means capable of providing the indication when an number of the copies counted by the counter exceeds the maximum possible number of copies that can be made until the concentration of the developer fully contained in the developing unit decreases to a value lower than a predetermined value.

With this arrangement, in the event that the sensor fails to operate properly, to detect the developer concentration and even though the copying operation has been cyclically performed to produce the copies in a number exceeding the maximum possible number of copies that can be made until the concentration of the developer fully contained in the developing unit decreases to a value lower than the predetermined value, the sensor and/or the concentration control unit can be judged as having encountered an abnormality and the warning indication can be issued to this effect. Therefore, the continued reproduction of copies while the quality of reproduced images has been deteriorated can be prevented and, also, the machine can be prevented from being adversely affected by the flow of some carrier particles into the interior of the machine. At the same time, the operator of the copying machine can be informed of the occurrence of the abnormality in the automatic developer concentration control device.

According to another aspect of the present invention, the warning device is characterized by the provision of an integrating means for integrating the respective densities of documents which have been copied to provide an integrated value, an integrated density storage region for storing an integrated value of a value corresponding to the integrated value and capable of being reset each time the developer is supplemented, and a warning means capable of providing the indication when the integrated value exceeds the maximum integrated density value during which copies can be made until the concentration of the developer fully contained in the developing unit decreases to a value lower than the predetermined value.

BRIEF DESCRIPTION OF THE DRAWINGS

This and other objects and features of the present invention will become clear from the following description taken in conjunction with preferred embodiments thereof with reference to the accompanying drawings, in which.

DETAILED DESCRIPTION OF THE EMBODIMENTS

Figure 2:
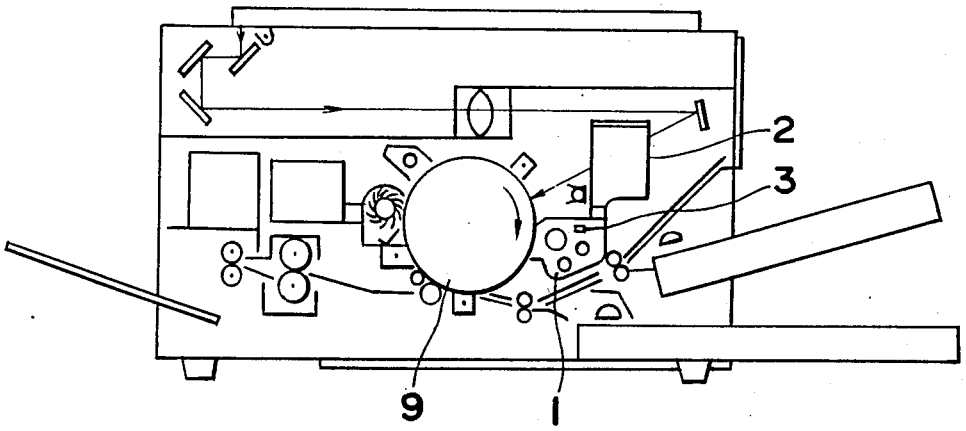
FIG. 2 is a schematic diagram showing the copying machine according to the preferred embodiment of the present invention.

Referring first to FIG. 2, a copying machine provided with a warning device according to a preferred embodiment of the present invention generally comprises a photosensitive receptor drum 9 supported for rotation in one direction. Around which drum 9 is disposed a charger, an optical projector lens assembly, a developing unit 1, a transfer unit, and others known to those skilled in the art. The developing unit 1 is provided with a toner concentration sensor 3 and a toner supply unit 2.

Figure 3:
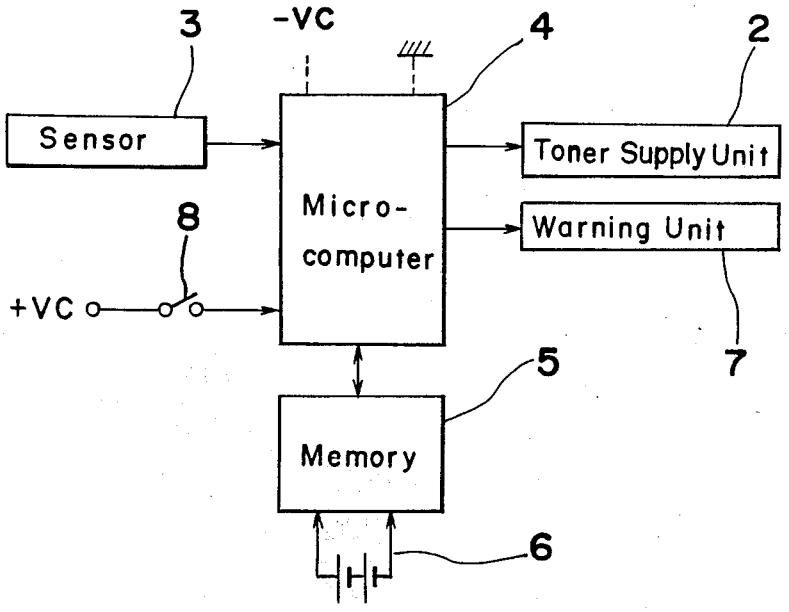
FIG. 3 is a block circuit diagram showing the circuitry employed in the copying machine shown in FIG. 2.

The control system of the copying machine is shown in FIG. 3 in circuit block diagram. A microcomputer 4 is connected with a memory 5 backed up by a battery 6, a toner concentration sensor 3, a toner supply unit 2, a warning unit 7, and a reset switch 8 for a counter as will be described later. The toner concentration sensor 3 is capable of generating, one at a time, a high level signal when the toner concentration within the developing unit is higher than a reference value, and a low level signal when it is equal to or lower than the reference value. The reset switch 8 is utilized by a servicing worker at the time of machine checking to reset the microcomputer 4.

Figure 1:
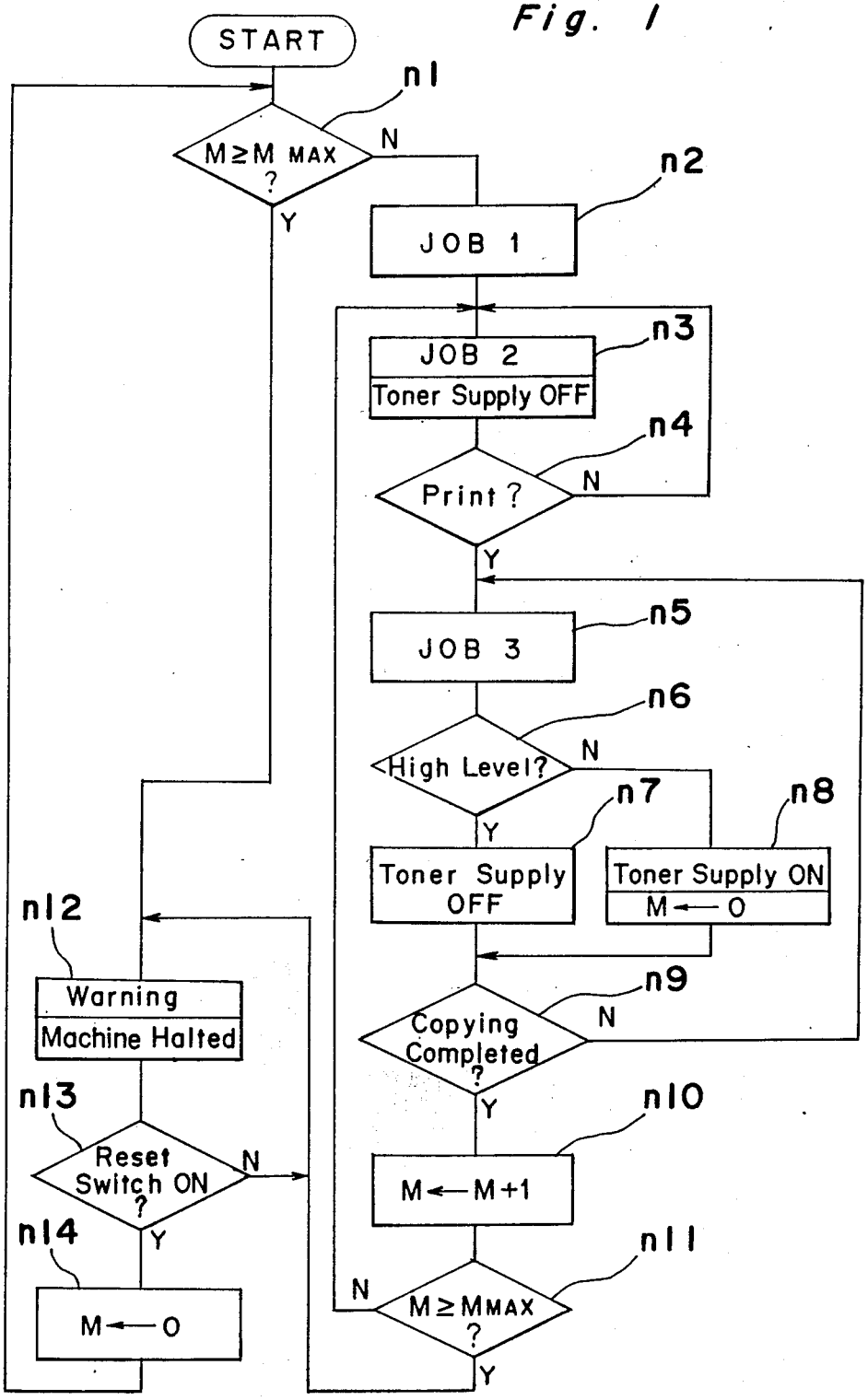
FIG. 1 is a flowchart showing the programmed sequential operation of a microcomputer used in a copying machine according to a preferred embodiment of the present invention.

FIG. 1 illustrates the sequence of operation of the microcomputer. The number M of copies being made is stored in the memory 5. This is for the purpose of integrating the number of copies made subsequent to the previous replenishment of the toner, regardless of whether the copying machine is powered or not.

Referring to FIG. 1, at step n1, a decision is made to determine if the number M of the copies is greater than the maximum possible number $M_{MAX}$ of copies that can be made until the concentration of the toner fully contained in the developing unit decreases to a value lower than the reference value. If the result of the decision indicates the copy number M is equal to or smaller than the maximum possible copy number $M_{MAX}$, the program flow proceeds to step n2, but if the former is found to be equal to or greater than the latter, this is indicative of the occurrence of an abnormality and the program flow proceeds to step n12. At step n2, a warm-up job (JOB 1) such as preheating of a fixing unit is carried out, followed by step n3 at which a stand-by job (JOB 2) such as, for example, display operation is carried out up until a print key is keyed in. At this time, the toner replenishing operation of the toner supply unit 2 does not take place. When the print key is keyed in at step n4, the copying operation takes place at step n5 to step n9. More specifically, at step n5, a copying job (JOB 3) such as, for example, rotation of the photosensitive drum and supply of electric power to the charger takes place, followed by checking of the level of an output from the toner concentration sensor 3 at step n6. If the level of the output from the sensor 3 is found to be high, this is indicative of a higher toner concentration within the developing unit than the reference value and the program flow proceeds to step n7, but if it is found to be low, this is indicative of the toner concentration equal to or lower than the reference value and the program flow proceeds to step n8. At step n7, the toner supply unit 2 is held inoperative to interrupt the supply of the toner into the developing unit. However, at step n8, the toner supply unit is brought into operation to effect the supply of the toner into the developing unit and, at the same time, the copy number M is zeroed. Subsequent to either step n7 or step n8, a decision is made at step n9 to determine if the copying has been completed. If it has not been completed yet, the program flow from step n5 to step n7 or n8 is repeated until the copying is completed.

When the result of the decision at step n9 indicates that the copying has been completed, the copy number M is incremented by 1 at step n10, followed by the comparison between the copy numbers M and $M_{MAX}$ at step n11. If the result of the comparison at step n11 indicates that the copy number M is equal to or greater than the maximum possible copy number $M_{MAX}$, this indicates that an abnormality occurring in the toner concentration sensor 3 the copying has taken place without the toner being replenished, and that copies have been made in a number equal to or greater than the maximum possible number $M_{MAX}$. Therefore, a warning is issued at step n12. This warning step n12 corresponds to a warning means provided in accordance with the present invention and is executed in such a way as to activate a warning display device provided exteriorly in the copying machine and, also, as to bring the copying machine to a halt. On the other hand, if the result of the comparison at step n11 indicates the copy number M as being smaller than the maximum possible copy number $M_{MAX}$, this is indicative of a normal condition and, therefore, the program flow returns to step n3. At step n13 following step n12, and when the servicing worker, after checking the machine, actuates the reset switch, the counter is cleared at step n14 with the program flow returning to the initial step n1.

Figure 4:
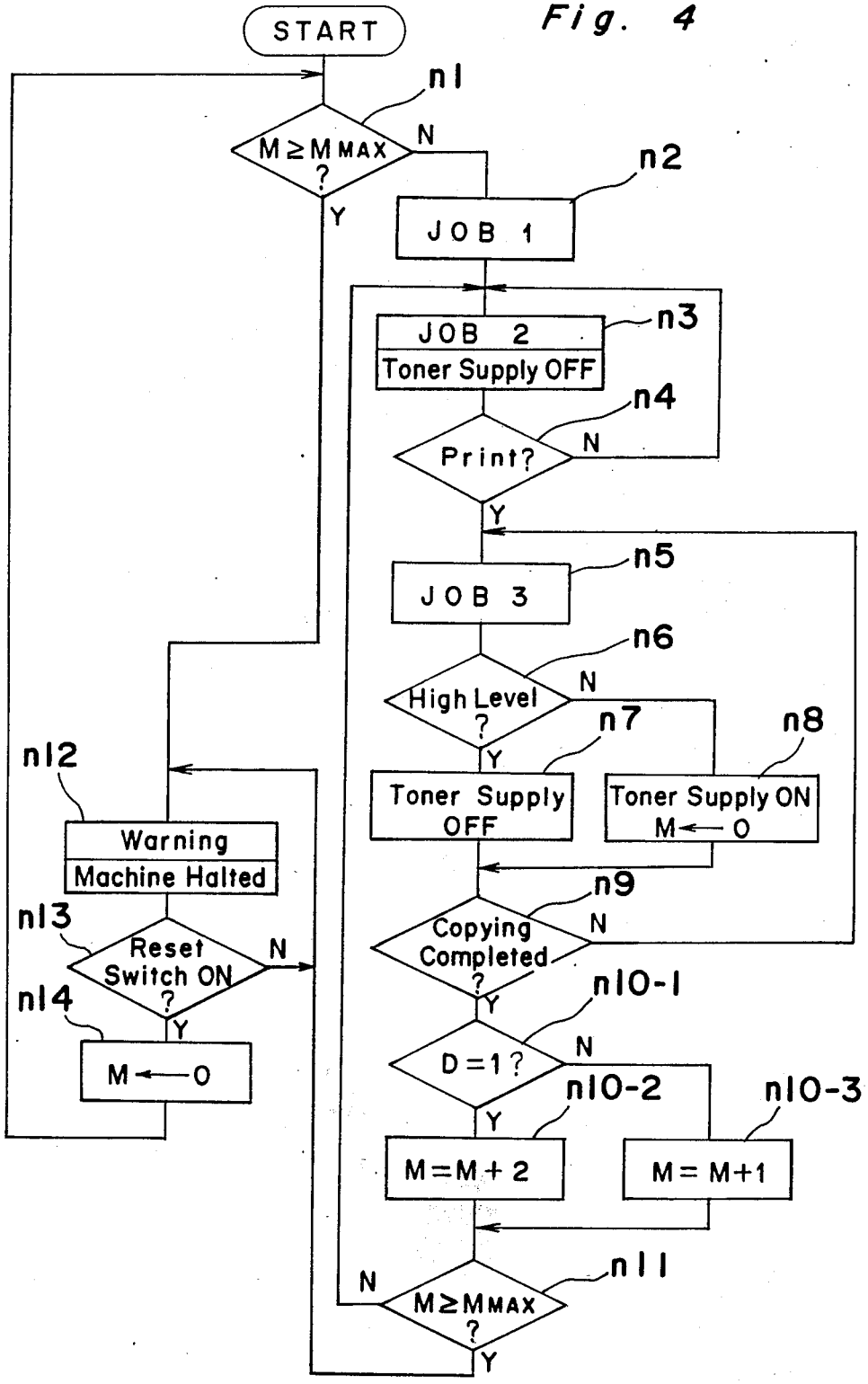
FIGS. 4 to 6 are diagrams similar to FIGS. 1 to 3, respectively, showing another preferred embodiment of the present invention.
Figure 5:
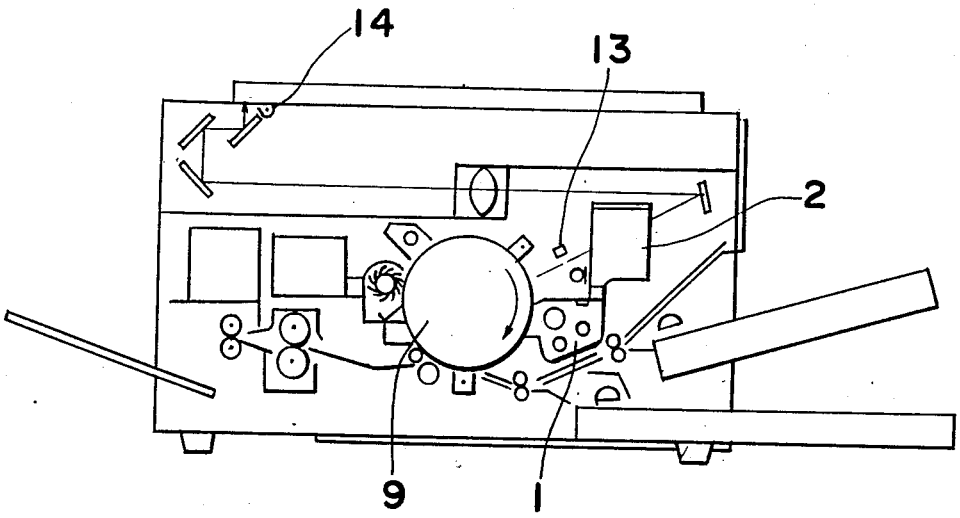
Figure 6:
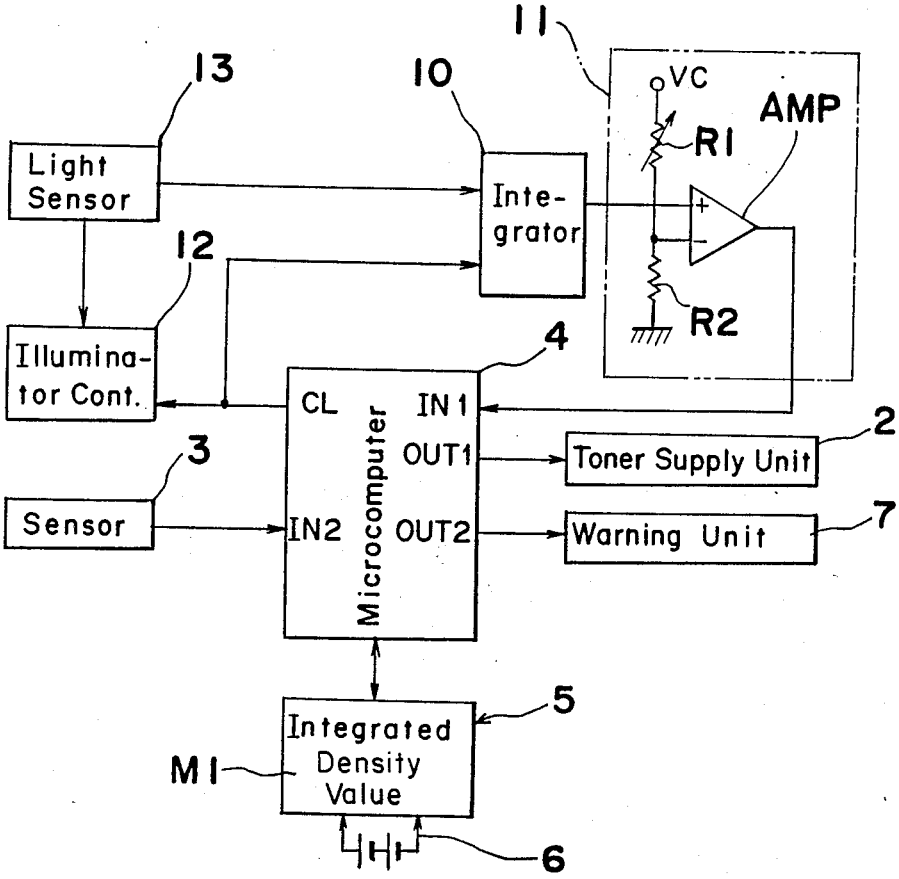

In the second preferred embodiment of the present invention shown in FIGS. 4 to 6, the copying machine used is similar to that shcwn in FIG. 2 except that, as shown in FIG. 5, a light sensor 13 for detecting the density of a document illuminated by an illuminator lamp 14 is disposed beneath an original support, and an illuminator control 12 is additionally employed for controlling the intensity of light emitted by the illuminator lamp 14. The light sensor 13 is disposed on the path of travel of an imagewise light reflected from the document towards the photosensitive drum 9.

The control system of the copying machine shown in FIG. 5 is shown in FIG. 6. The microcomputer 4 shown therein is connected with the memory 5 backed up by the battery 6, the toner concentration sensor 3, the toner supply unit 2, the warning unit 7, and the illuminator control 12. The light sensor 13 shown in FIG. 5 is connected to both the illuminator control 12 and an integrator 10 for integrating the detected density. The integrator 10 after having integrated the detected value of the density outputs an output signal indicative of the integrated value to a comparing circuit 11 which is in the form of an ON-OFF circuit comprising an operational amplifier AMP, a variable resistor R1 and a resistor R2.

The comparing circuit 11 is designed such that an output signal "1" can be fed to the microcomputer 4 when the integrated value applied to a non-inverting input of the amplifier AMP exceeds a predetermined value determined by the resistors R1 and R2, but an output signal "0" will be fed to the microcomputer 4 when it does not exceed the predetermined value. The microcomputer 4 utilizes the output from the comparing circuit 11 to synthesize a value corresponding to the integrated value and accumulate it in an accumulated concentration storage region as will be described later. As is the case in the foregoing embodiment, the toner sensor 3 generates a high level signal and a low level signal when the toner concentration within the toner supply unit is equal to or higher than the reference value and when it is lower than the reference value, respectively, this reference value being so determined as to match the integrated value of standard density of the document. The memory 5 is provided with the accumulated density storage region (area M1) for the storage of a value corresponding to the above described integrated value. In the embodiment shown in FIGS. 4 to 6, as will be described later, the microcomputer 4 synthesizes [2] and [1] as the value corresponding to the integrated value when the output from the comparing circuit 11 is "1" and "0", respectively. It is however to be noted that the value corresponding to the integrated value may comprise the integrated value itself.

The sequence of operation of the microcomputer 4 shown in FIG. 5 is shown in FIG. 4 wherein the accumulated density value of the document copied, which the storage region accumulates and stores, is designated by M while the maximum accumulated density value is designated by $M_{MAX}$. The value M is stored in the area M1 of the memory 5. This is for the purpose of accumulating the copy density integrated value subsequent to the previous toner replenishment regardless of whether the power source for the copying machine is turned on or off.

As can readily be understood from the comparison of FIG. 4 with FIG. 1, the program flow shown in FIG. 4 is generally identical with that shown in FIG. 1 except that steps n10-1, n10-2 and n10-3 supersede step n10 shown in FIG. 1. As shown, after the copying has been completed as determined at step n9 in the manner as hereinbefore described in connection with the foregoing embodiment, a decision is made at step n10-1 to determine if the output from the comparing circuit 11 is 1". If the result of the decision at step n10-1 indicates that the output from the comparing circuit 11 is "1", then the document of a high density and, therefore, the value [2] corresponding to the integrated density value of such document is added to the value M at step n10-2. However, if the result of the decision at step n10-1 indicates that the output from the comparing circuit 11 is "0", this then the document of a low density and, therefore, the value [1] corresponding to the integrated density value of such document is added to the value M at step n10-3. The values M and $M_{MAX}$ are then compared at steps n11 in the manner as hereinbefore described with reference to FIG. 1.

Although the present invention has been described in connection with the preferred embodiments thereof with reference to the accompanying drawings, it is to be noted that various changes and modifications will be apparent to those skilled in the art from this detailed description. Such changes and modifications are, unless departing from the scope of the present invention as defined by the appended claims, to be understood as included therein.

What is claimed is:

1. A copying machine comprising:

a sensor for detecting the concentration of a powdery developer within a developing unit;

a developer supply unit for supplementing a powdery developer into said developing unit when the concentration of said developer detected by said sensor is lower than a predetermined value; and a warning device including a counter for counting the number of copies being made and capable of being reset each time the developer is supplemented from the developer supply unit onto the developing unit, and warning means for indicating when the number of copies counted by said counter exceeds a maximum possible number of copies that can be made until the concentration of the developer fully contained in the developing unit decreases to a value lower than a predetermined value.

2. A copying machine comprising:

a light sensor for detecting the density of a document to be copied;

concentration control means for controlling toner concentration on the basis of the density detected by said light sensor;

a developer sensor for detecting the concentration of a powdery developer within a developing unit;

a developer supply unit for supplying a powdery developer into said developing unit when the concentration of the developer detected by said developer sensor is lower than a predetermined value; and a warning device including means for integrating the respective densities of documents which have been copied to provide an integrated value, an integrated density storage region for storing an integrated value of a value corresponding to the integrated value, said storage region being reset each time the developer is supplemented, and warning means for indicating when the integrated value exceeds the maximum integrated density value during which copies can be made until the concentration of the developer fully contained in the developing unit decreases to a value lower than the predetermined value.

* * * * *